United States Patent [19]

Nelson

[11] Patent Number: 4,576,424

[45] Date of Patent: Mar. 18, 1986

[54] ARTIST'S WORK AND STORAGE STATION

[75] Inventor: John E. Nelson, Mountaintop, Pa.

[73] Assignee: Eberhard Faber, Inc., Wilkes-Barre, Pa.

[21] Appl. No.: 593,834

[22] Filed: Mar. 27, 1984

[51] Int. Cl.[4] ..... A47B 46/00

[52] U.S. Cl. ..... 312/231; 312/312; 312/316

[58] Field of Search ..... 312/231, 312, 282, 209, 312/316

[56] References Cited

U.S. PATENT DOCUMENTS

| | | | |
|---|---|---|---|
| 217,510 | 7/1879 | Butts | 312/312 |
| 559,330 | 4/1896 | Hill | 312/312 |
| 2,244,036 | 6/1941 | Williman et al. | 108/9 |
| 2,244,391 | 6/1941 | De Lisle | 108/9 |
| 2,931,685 | 4/1960 | Butler | 312/312 |
| 3,372,964 | 3/1968 | Eversman | 312/350 |
| 3,494,306 | 2/1970 | Aguilar | 108/6 |
| 3,514,173 | 5/1970 | Ford | 312/231 |

*Primary Examiner*—William E. Lyddane
*Assistant Examiner*—Joseph Falk
*Attorney, Agent, or Firm*—LeBlanc, Nolan, Shur & Nies

[57] ABSTRACT

A cabinet is disclosed which is generally rectangular and may have a plurality of drawers therein. A top section, however, may be lifted and rotated outwardly to form a drawing board which is angularly adjustable and includes sufficient knee room to permit an artist to comfortably sit at the drawing board. The drawing board is mounted on a U-shaped support disposed within the cabinet and is hingedly attached to the forward edge thereof. The support forms J-slots in opposed legs of the U. The cabinet frame supports outstanding walls received within the U which mount rollers adapted to ride in the J-slots. The drawing board portion of the top then with the attached U-shaped member is lifted upwardly and outwardly as the rollers travel along the J-slots to lock in an upright position for use. A slotted brace also is provided with a locknut connecting the rear portion of the board with the legs of the U so that the rear portion of the board may be elevated to provide the desired sloping surface. In the upright position the base of the U-shaped member locks against the front inside wall of the cabinet to stabilize the drawing surface.

6 Claims, 5 Drawing Figures

ARTIST'S WORK AND STORAGE STATION

This invention relates to a cabinet, taboret, desk or the like which is adapted for use by an artist or draftsman. This invention relates to an article of furniture which has a flat top surface, a portion of which may be raised and angled outwardly to provide a drawing board with sufficient knee clearance for use by an artist or draftsman seated on a chair.

The prior art contains a number of collapsible writing desks, drafting boards, and the like. See, for example, Canadian Pat. No. 643,700, and U.S. Pat. Nos. 2,244,391 and 3,494,306. In the case of the latter two U.S. patents, the drafting board or writing surface is fully visible as such and only rotated into an angled relationship for use. In the Canadian patent, however, a desk is disclosed wherein the drawing board forms, in one embodiment, a vertical surface thereof. When in use the board rotates upwardly and is secured by wing-nuts at the preferred angle. While this device when not in use maintains the drawing board in an unobtrusive position, in use the drawing board must be secured by wingnuts. Accordingly, because of the absence of a fixed locking support, the device is relatively unstable when the drawing board is in use.

The device of the instant invention is designed to provide an unobtrusive piece of furniture which may have the appearance of a cabinet or the like when not in use, and can have a plurality of drawers therein. However, when in use a portion of the upper surface can be raised and rotated outwardly to rest in a stable position whereby the device may be utilized by a draftsman or artist. In addition the device of this invention provides an adjustable feature whereby the drawing board may be angled at a desired angle. When the drawing board is in the upper useable position, and is disposed horizontally, it is in a fixed position fully supported by the walls of the cabinet. It then can be raised to a moderate angle by use of a bracket and secured by conventional means such as a wing-nut or the like. It must be emphasized, however, that in the upright position the drawing board is fully supported by the walls of the cabinet and by a U-shaped support member which rotates into engagement with the front wall thereof. When rotated into an angled position relative to the horizontal, and secured by, for example, a lock-nut, even if the lock-nut becomes worn the drawing board will not retract into its lowered position unless the entire assembly is rotated. Accordingly, when the device is in the upright position it is fully stable and useable and not supported by, for example, a lock-nut, wing-nut, or the like in a slotted brace.

The device of this invention achieves a stable upper position for the drawing board by providing a U-shaped mounting assembly to which the drawing board is hingedly attached. The assembly forms J-slots which receive rollers mounted on internal supports which in turn are mounted on the cabinet walls. The rollers act as followers in the J-slot cam surfaces so that when the device is moved from the lower to the upper position, the drawing board and U-shaped support are physically lifted upwardly and outwardly, and as the followers seat in the short legs of the J-slots the base of the U-shaped assembly abuts a front wall of the cabinet to thereby lock the drawing board in the upper position. A reversal of the process is required in order to retract the drawing board into the lowered position wherein it becomes a portion of the top surface of the cabinet.

Accordingly it is an object of this invention to provide a cabinet mounted drawing board which may be raised and rotated outwardly into a stable useable position having sufficient leg room to permit an artist or draftsman to be seated in front thereof for use.

It is yet another object of this invention to provide a cabinet mounted drawing board which in its upper useable position is locked in place against movement to the lowered position, and when in the lowered position becomes a portion of the upper surface of the cabinet.

It is yet another object to provide an unobtrusive piece of furniture having the normal appearance of a cabinet in which a portion of the upper surface may be lifted and rotated outwardly to form a drawing board-desk for use by an artist or draftsman and which drawing board can be angularly adjusted as desired when in the upper position.

These and other objects will become readily apparent with reference to the drawings and following description wherein.

Figure 1:
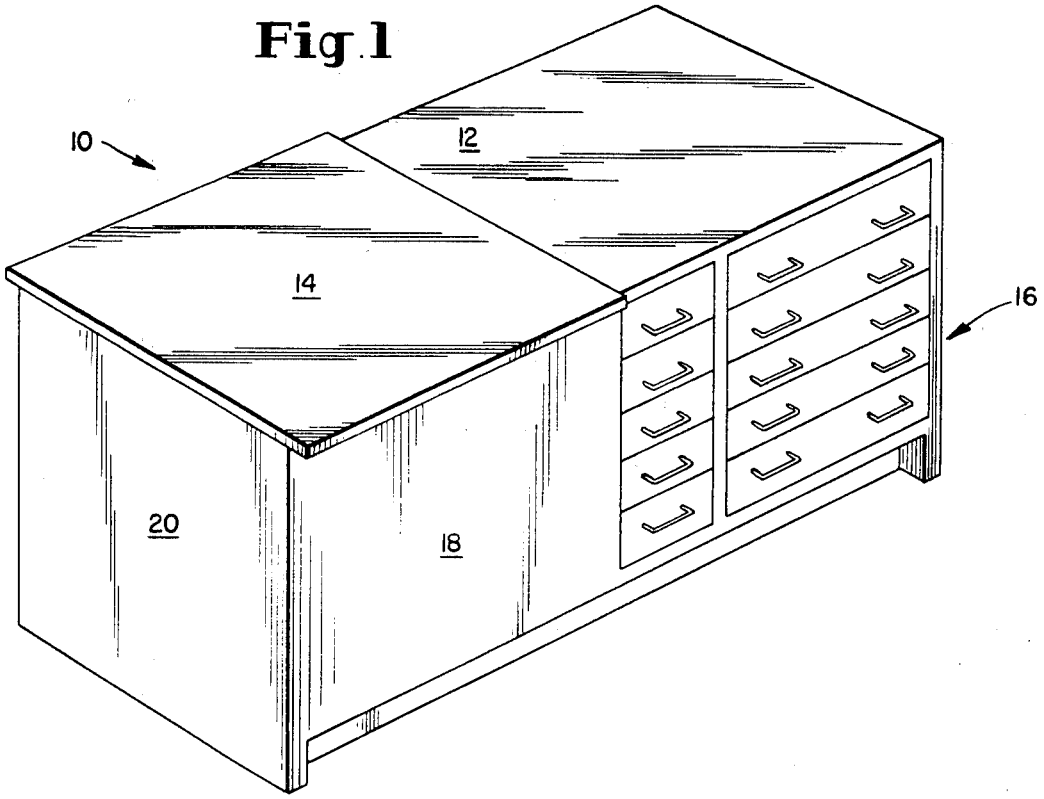
FIG. 1 is a perspective view of the cabinet of this invention with the drawing board in the closed or lowered position.
Figure 2:
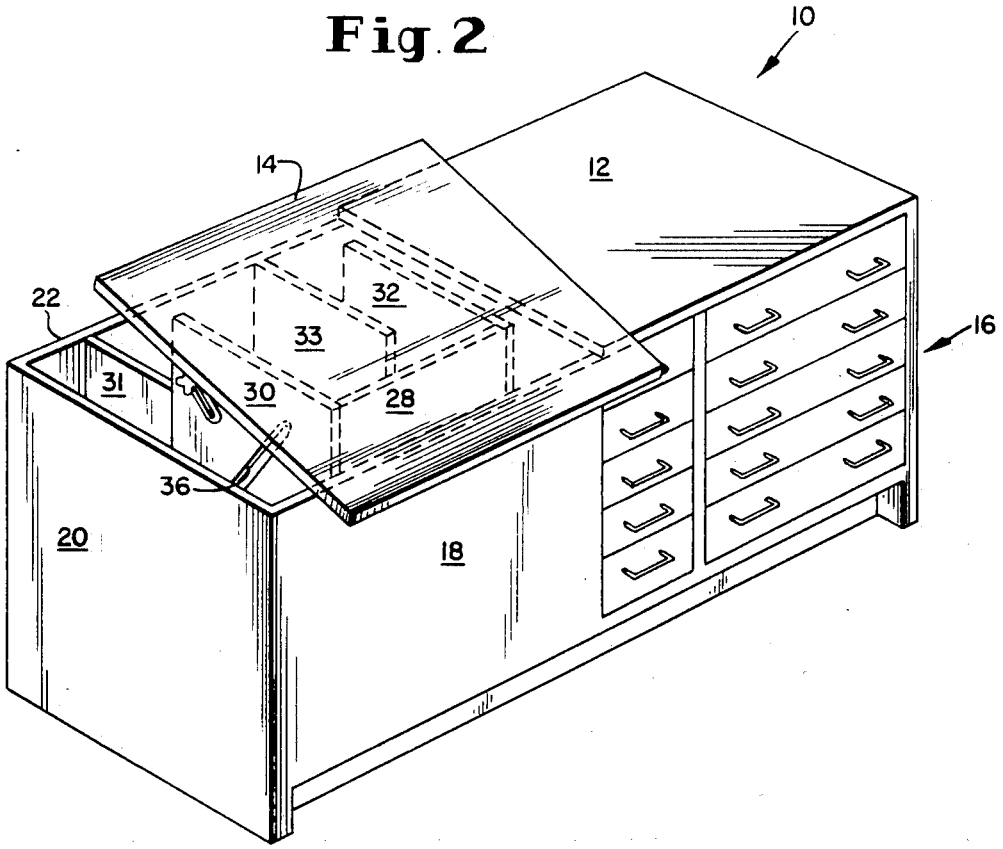
FIG. 2 is a perspective view of the cabinet of FIG. 1 showing the drawing board in the raised position.

With attention to the drawings, the cabinet of this invention 10 as pictured in FIGS. 1 and 2 typically includes a flat horizontal surface 12, a portion of which comprises a drawing board 14. Cabinet 10 may have a plurality of drawers 16, for example, on the righthand side of drawing board 14. As will be obvious to those skilled in the art, however, the device of this invention could include drawers on either side or on both sides of the drawing board 14, or in fact, the cabinet 10 may be designed without drawers as desired. The drawers 16 then are only an optional feature included as an example, and not intended to be limitative of the patentable features of this invention.

Cabinet 10 includes a front wall 18, side walls 20, and a rear wall 22. Cabinet 10 preferably is substantially rectangular in cross-section and may be of any desired height from that of a low taboret intended to sit on another table, or a free-standing cabinet as shown in FIGS. 1 and 2.

In order utilize drawing board 14 it is necessary for the board to be raised and rotated outwardly as shown in FIG. 2. In this way, an artist or draftsman can sit in front of a drawing board and sufficient knee room is provided between the artist or draftsman and the front wall 18. As will be obvious to those skilled in the art, if the board 14 is not rotated outwardly so that a portion thereof extends over wall 18, there will be no knee room provided for the user.

Figure 3:
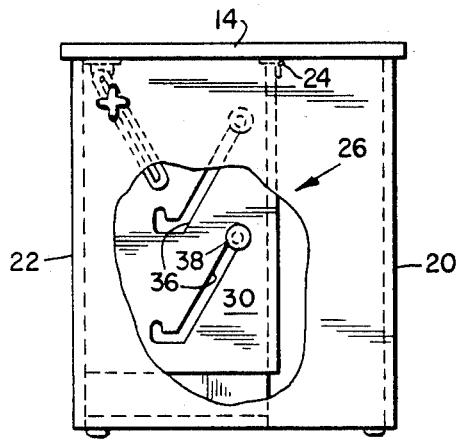
FIG. 3 is a side view of the cabinet of FIG. 1 with a portion of the side wall removed.
Figure 4:
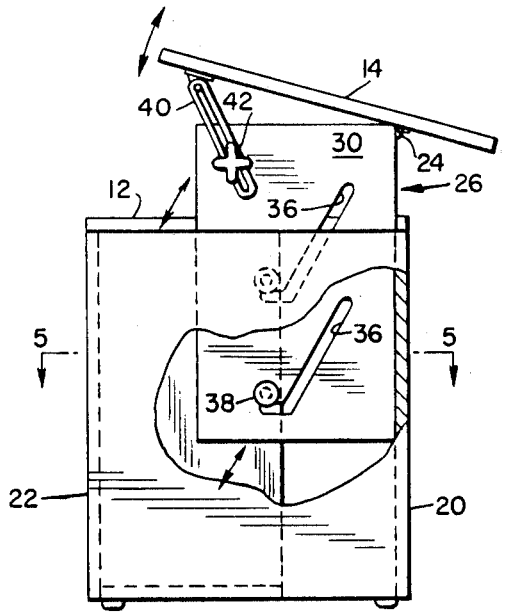
FIG. 4 is a side view of the cabinet of FIG. 2 with a portion of the side wall removed.
Figure 5:
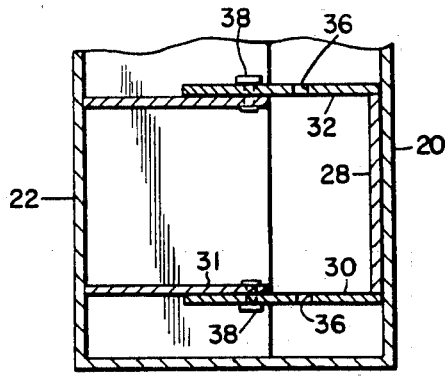
FIG. 5 is a view taken along line 5—5 of FIG. 4.

With attention to FIGS. 3–5, drawing board 14 is attached preferably by hinge 24 in the lower surface thereof to U-shaped support member 26. Support member 26 includes an upright base member 28 and upright side members 30 and 32, which together form a U in cross-section as shown in FIG. 5. Vertical support members 31 and 33 are affixed to back wall 22, and received abutting and between vertical leg members 30 and 32. Leg members 30 and 32 define pairs of J-slots 36 which act as cam surfaces. Rollers 38 are mounted on support members 31 and 33. Rollers 38 extend through J-slots 36 and serve as cam followers.

Accordingly, as drawing board 14 and attached support member 26 are lifted, rollers 38 will travel in slots 36 from the position shown in FIG. 3 to the position shown in FIG. 4, whereby the drawing board 14 will be locked in an upright position by rollers 38 in the lower leg of J-slot 36 and by the wall 28 of U-shaped support member 26 abutting the interior surface of front wall 20 of cabinet 10. In order to move drawing board 14 into a position at an angle to the horizontal as shown in FIG. 4, at least one slotted bracket 40 is provided which is affixed to the underside of drawing board 14. A lock-nut 42 is also mounted on the outer surface of, in FIG. 4, leg member 30 to secure, in the conventional fashion, drawing board 14 at the desired angle to the horizontal. As will be obvious to those skilled in the art, if desired, a second slotted member (not shown) may be correspondingly mounted on the opposite side of U-shaped support member 26 at leg member 32 for additional support.

In operation, in order to utilize the drawing board 14, board 14 and the attached U-shaped support 26 are lifted vertically whereby rollers 38 travel along J-slots 36 from the position shown in FIG. 3 to the locked position shown in FIG. 4. This results in movement of the drawing board both upwardly and outwardly whereby the drawing board 14 will overhang the front wall 20 of cabinet 10 to provide leg room for an artist or draftsman using the same. After the drawing board has been moved to the upright position, lock-nut 42 is loosened and the board moved from the horizontal to the desired angle whereupon lock-nut 42 is tightened to retain the drawing board in the position shown in FIG. 4.

In order to disassemble the board, lock-nut 42 is loosened whereby the board rotates about hinge 24 from a position at an angle to the horizontal, to a horizontal position. The assembly of drawing board 14 and U-shaped support 26, is then lifted and pushed towards back wall 22 whereby rollers 38 travel along J-slots 36 from the position shown in FIG. 4 to the position shown in FIG. 3. At this point, the cabinet is fully assembled in the position shown in FIG. 1, whereby drawing board 14 becomes a portion of upper surface 12. Although the drawing board shown in FIG. 1 is slightly larger than the surface portion 12, as will be obvious to those skilled in the art, the board could be similarly dimensioned so that in the position of FIG. 1 the device will have the appearance of a cabinet having a continuously dimensioned, horizontal top.

As previously indicated, the device pictured in the drawings herein shows a plurality of drawers 16 disposed on the right side of the cabinet 10. It will be obvious to those skilled in the art in view of the foregoing that drawers in the cabinet are not a part of the instant invention. Accordingly, drawers may or may not be present in a device embodying the drawing board and support beams hereinabove described.

Furthermore, while the movement of the drawing board from a horizontal position to a position at an angle to the horizontal has been described hereinabove as controlled by a lock-nut and slotted brace, as will be obvious to those skilled in the art, any conventional similar type of brace may be used such as a spring detent or the like.

In addition, the device of this invention has been described utilizing twin J-slots 36 and rollers 38 on each side of the U-shaped support member 26. As will be obvious to those skilled in the art, one or more of such J-slots could be utilized, and the pairs described herein are preferred examples.

The invention may be embodied in other specific forms without departing from the spirit or essential characteristics thereof. The present embodiment is, therefore, to be considered in all respects as illustrative and not restrictive, the scope of the invention being indicated by the appended claims and all changes which come within the meaning and range of equivalency of the claims are, therefore, intended to be embraced therein.

We claim:

1. A drawing board and support assembly collapsible into a cabinet wherein the drawing board forms at least a part of the upper surface thereof comprising:

an outer support having upstanding front, rear and side walls;

inner support means including mutually spaced wall members disposed parallel to the side walls of the outer support and fixed at an edge thereof to the inner surface of the outer support;

U-shaped member slidably disposed within said outer support with the wall members received therewithin; the outer surface of each of said wall members being disposed adjacent the inner surface of a corresponding leg of said U, the base of said U being disposed parallel to the front wall of said outer support;

a drawing board hingedly attached to the upper surface of said U-shaped member at the base thereof;

releasable guide means for guidinig sliding movement of said U-shaped member and drawing board between a lowered position wherein said board is disposed in a horizontal position resting on at least a portion of the upper surface of said outer support, and a raised position wherein said board is fixed in a position above the outer support with a portion thereof extending outwardly of the front wall of the outer support and the U-shaped member abuts a corresponding portion of the inner surface of the front wall of the outer support to lock said member against downward movement; and adjustment means connected between the U-shaped member and said drawing board for permitting rotation thereof about the hinge connection between a first position wherein the board is horizontal and a second position wherein the board is disposed at a predetermined angle to the horizontal, including lock means for releasably holding said board in a predetermined position.

2. The device of claim 1 wherein said adjustment and lock means comprise at least on slotted guide bracket depending from a lower surface of said board adjacent a corresponding outer surface of a leg of said U-shaped member and a rotatable lock nut means mounted of the surface of said leg and slidably extending through the slot for locking said bracket against the surface of the leg.

3. The device of claim 2 wherein said guide means comprises cam and follower means carried by the legs of said U-shaped member and said inner support means for guiding movement of said board between the lowered position and the raised position.

4. The device of claim 3 wherein said cam means comprises a plurality of J-slots formed in the legs of said U-shaped member and said follower means comprises a plurality of rollers mounted on the wall members, each roller extending through a corresponding J-slot.

5. The device of claim 4 wherein said outer support further comprises drawer means mounted in the front wall for providing storage space contained within said outer support.

6. The device of claim 4 further comprising a cover fixed to a poriton of the upper surfaces of a side wall and front and back walls dimensioned so that when the drawing board is in the lowered position the board and cover will form the upper surface of said cabinet.

* * * * *